United States Patent [19]

Talkington

[11] 3,936,895

[45] Feb. 10, 1976

[54] BENTHIC BOBBING BUOY

[75] Inventor: Howard R. Talkington, La Jolla, Calif.

[73] Assignee: The United States of America as represented by the Secretary of the Navy, Washington, D.C.

[22] Filed: Jan. 14, 1975

[21] Appl. No.: 540,781

[52] U.S. Cl. ..... 9/8 R; 73/170 A; 114/16 R

[51] Int. Cl.[2] ..... B63B 21/52; G01F 23/10

[58] Field of Search ..... 9/8 R; 114/16 R, 16 E, 114/16.5, 206 R, 230; 73/107 R, 107 A; 102/14; 116/26

[56] References Cited

UNITED STATES PATENTS

| | | | |
|---|---|---|---|
| 2,422,337 | 6/1947 | Chilowsky | 9/8 R |
| 3,295,489 | 1/1967 | Bossa | 114/206 R |
| 3,590,635 | 7/1971 | Duing | 73/170 A |
| 3,680,160 | 8/1972 | Heikki | 9/8 R |

*Primary Examiner*—Trygve M. Blix
*Assistant Examiner*—Charles E. Frankfort
*Attorney, Agent, or Firm*—Richard S. Sciascia; Ervin F. Johnston

[57] ABSTRACT

A benthic bobbing buoy system which includes an anchor, a buoy, and an anchor line connecting the buoy to the anchor, the anchor line being of a length to establish the buoy at a submerged position. Another buoy for bobbing between the surface of the water and a submerged position is connected by another line to the submerged buoy. Provision is made for selectively changing the buoyancy of the bobbing buoy between a positively buoyant condition to a less positively buoyant condition, and provision is made for limiting the descent of the bobbing buoy when the bobbing buoy is less positively buoyant. With such an arrangement the bobbing buoy can repeatedly bob between the surface of the water and a predetermined depth.

6 Claims, 6 Drawing Figures

(SUBMERGED)

(SURFACED)

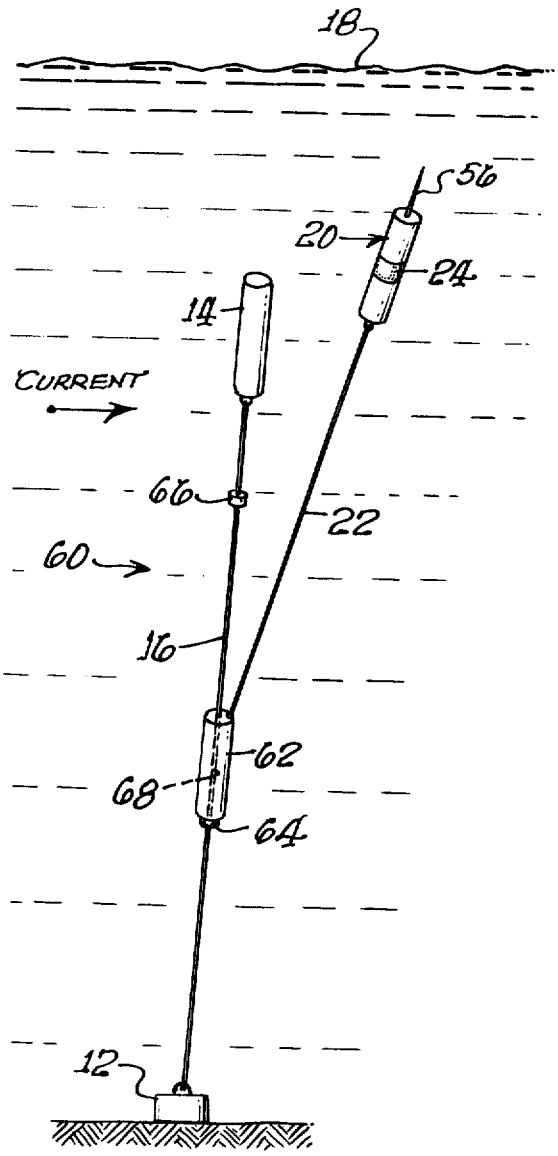
FIG. 3. (SUBMERGED)
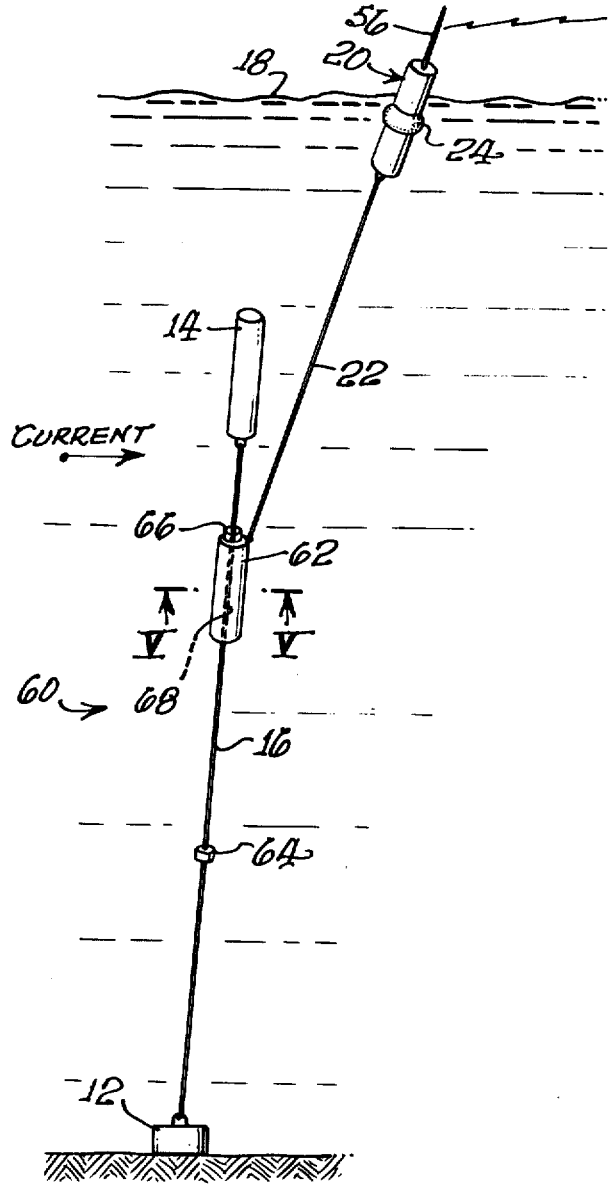
FIG. 4. (SURFACED)
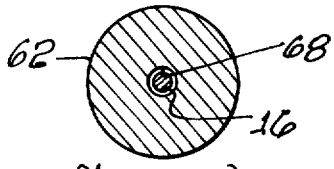
FIG. 5.

BENTHIC BOBBING BUOY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Oceanographic data, such as temperature of the water, plays a key role in predicting sonar conditions and even the migration and location of fish. Temperature data over large ocean areas is primarily obtained from temperature sensors which are wire connected to surface ships. When temperature data in a particular ocean area is desired a buoy system is commonly utilized with a submerged temperature sensor. One such system is a bobbing type buoy which descends and collects the temperature information and then ascends to the surface of the ocean and transmits this data to a remote location. In order to obtain the bobbing action the buoy is connected to a sea-anchor and contains a powered winch which alternately winds the buoy up and down between the surface and a submerged position for the collection of data and transmission of the collected data to a remote location. The powered winch has several serious drawbacks, namely: (1) The electrical noise of the winch which interfers with the transmission of the data, and (2) excessive power consumption by the winch because of its relatively massive components. Accordingly, there has been a strong need for an improvement in the prior art winch powered bobbing buoy systems to eliminate the problems associated therewith.

SUMMARY OF THE INVENTION

The present invention overcomes the problems associated with the powered winch bobbing buoy systems by providing a system which is practically free of noise and utilizes a minimum of power. This has been accomplished by providing an anchor, a buoy, and an anchor line which connects the buoy to the anchor, the anchor line being of a length to establish the buoy at a submerged position. Another buoy for bobbing between the surface of the water and a predetermined submerged position is connected by a line to the first submerged buoy. Means are provided for selectively changing the buoyancy of the bobbing buoy between a positively buoyant condition to a less positively buoyant condition, and means are provided for limiting the descent of the bobbing buoy when the bobbing buoy is less positively buoyant. With this arrangement the bobbing buoy will repeatedly bob between the surface of the water and the predetermined depth.

DESCRIPTION OF THE DRAWINGS

FIG. 3 is a schematic illustration of another embodiment of the invention with the bobbing buoy at a predetermined submerged position.

FIG. 4 is a schematic illustration of the other embodiments of the invention with the bobbing buoy in a surface position.

FIG. 5 is an enlarged cross-section taken along V—V of FIG. 4.

DESCRIPTION OF THE PREFERRED EMBODIMENT

Figure 1:
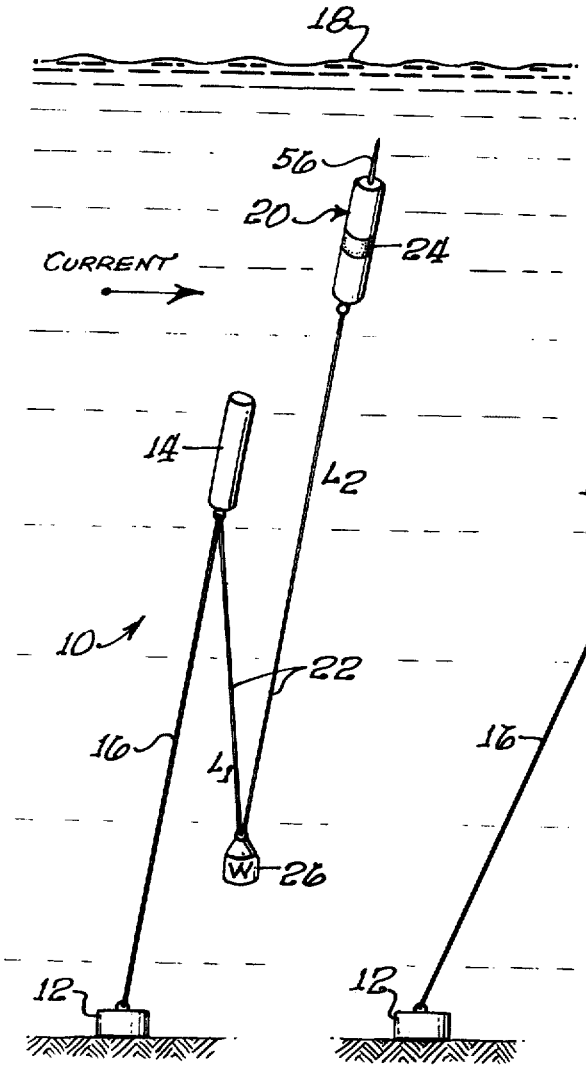
FIG. 1 is schematic illustration of one embodiment of the invention with the bobbing buoy at a predetermined submerged position.

Referring now to the drawings wherein like reference numerals desiginate like or similar parts throughout the several views there is illustrated in FIG. 1 a benthic bobbing buoy system 10 which includes an anchor 12, a buoy 14, and an anchor line 16 which connects the buoy 14 to the anchor 12. The anchor line 16 is of a length which is sufficient to establish the buoy 14 at a submerged position below the surface of the water 18. Since the submerged buoy 14 is positively buoyant, the anchor 12, which may be simply a concrete clump, is of a sufficient weight to overcome the buoyancy of the buoy 14 and maintain its position under prevailing tide and current conditions.

Figure 2:
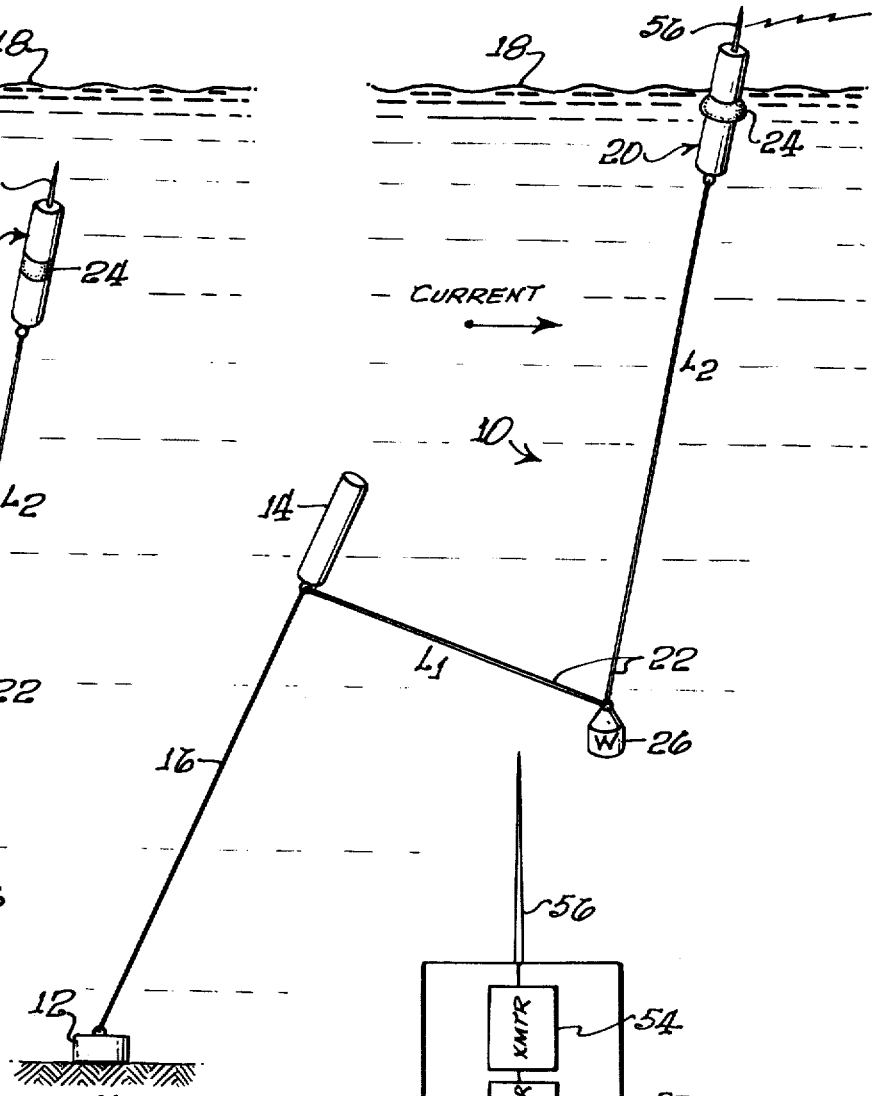
FIG. 2 is a schematic illustration of the one embodiment of the invention with the bobbing buoy at a surface position.

Another buoy 20 is utilized for bobbing between the surface of the water, as illustrated in FIG. 2, and a submerged position, as illustrated in FIG. 1. A bobbing line 22 connects the bobbing buoy 20 to the submerged buoy 14. Means 24, which will be described in detail hereinafter, is utilized for selectively changing the buoyancy of the bobbing buoy 20 between a positively buoyant condition to a less positively buoyant condition so as to obtain the bobbing action as illustrated in FIGS. 1 and 2. The buoyancy changing means causes the bobbing buoy 20 to become positively buoyant so as to ascend from its submerged position in FIG. 1 to the surface position in FIG. 2; then after a period of time to become less positively buoyant so as to descend once again to assume its submerged position as illustrated in FIG. 1. This action will repeatedly occur so that the bobbing buoy bobs between the submerged and surface positions.

It is important that the bobbing buoy 20 be limited in its descent so that it will be established at the predetermined depth for collecting the oceanographic data. This has been accomplished by providing means for limiting the descent of the bobbing buoy 20 when the bobbing buoy is less positively buoyant. The descent limiting means for the embodiment illustrated in FIGS. 1 and 2 includes a weight 26 which is fixedly connected to the bobbing line 22 intermediate its ends. The weight 26 for cooperating with bobbing buoy 20 to form a bobbing buoy-weight system and establishes two lengths to the bobbing line 22, namely: (1) $L_1$ which is the length of the bobbing line 22 between the submerged buoy 14 and the weight 26 and (2) $L_2$ which is the length of the bobbing line 22 between the weight 26 and the bobbing buoy 20. The length $L_2$ establishes the submerged depth of the bobbing buoy 20 for collecting oceanographic data. It is desirable that $L_2$ be greater than $L_1$ so that when the bobbing buoy 20 is in the surfaced position, as illustrated in FIG. 2, a downward force exists on the submerged buoy 14 through the length $L_1$. Accordingly, during both the submerged and surface modes of the bobbing buoy 20 a tension will be maintained in all of the lines so as to minimize the chance of any entanglement thereof. In FIGS. 1 and 2 there is illustrated a slight current in the water. Because of the arrangement described hereinabove for the bobbing buoy system 10 the tension on the lines will remain substantially static in either the submerged or surface modes even though there are current changes.

Figure 6:
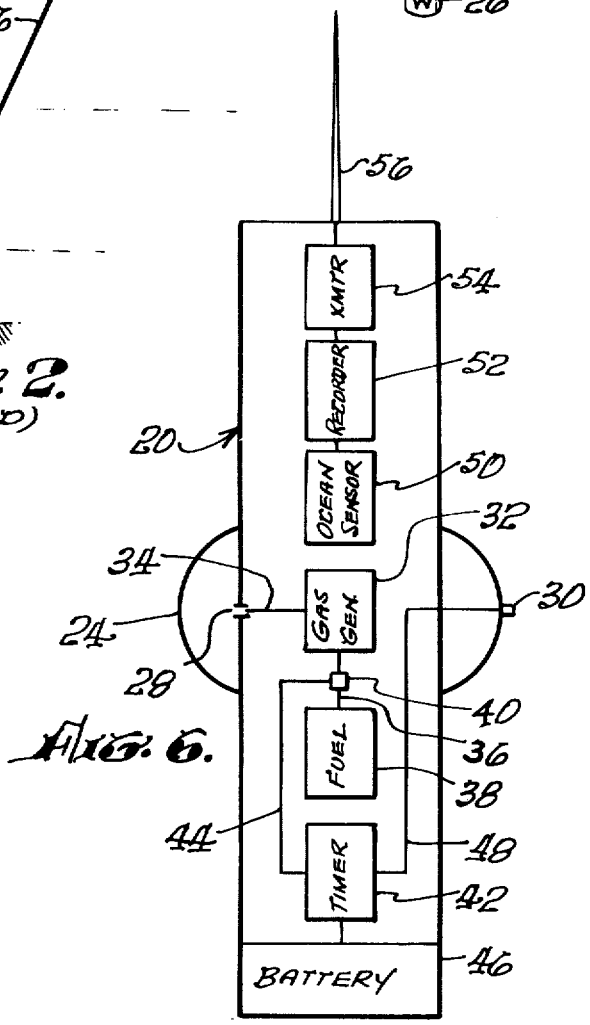
FIG. 6 is a schematic exemplary illustration of the components of the bobbing buoy.

Exemplary buoyancy changing means are illustrated in FIG. 6. The buoyancy changing means should provide sufficient buoyancy to surface the bobbing buoy 20 so it can transmit collected oceanographic data, and yet provide a sufficient decrease in buoyancy so that the bobbing buoy can descend to a predetermined depth for collecting the oceanographic data. The buoyancy changing means may include a toroidal shaped inflatable bag 24 which is mounted about the bobbing buoy 20 intermediate its end. The bag 24 may have an inlet 28 for receiving gas and an electrically operated outlet valve 30 for dispelling gas. An exemplary means for providing the gas may include a gas generator 32 which has an outlet line 34 connected to the gas inlet 28 and a line 36 connected to a fuel tank 38. The fuel tank 38 may be a pressurized tank of hydrazine and the gas generator 32 may have a catalyst so that when the hydrazine enters the gas generator gas is generated for inflating the bag 24. In order to control the flow of hydrogen fuel from the tank 38 to the gas generator 32 an electrically operated valve 40 may be provided which is connected to a timer 42 by an electric lead 44. The timer 42, which may receive its power from a battery 46, is also connected by an electric lead 48 to the electrically operated outlet valve 30. The timer 42 is programmed to alternately open and close the valves 40 and 30 so that the toroidal shape bag 24 is alternately inflated to provide positive buoyancy to the bobbing buoy 20 and then deflated to provide a decrease in buoyancy to the bobbing buoy. Accordingly, (1) when the valve 40 is opened the valve 30 will be closed, (2) after the bag 24 has been sufficiently inflated both valves 40 and 30 are closed, (3) after a predetermined period the valve 30 is opened while the valve 40 is closed, and (4) after the bag 24 has been deflated both valves 30 and 40 are closed. This cycle will continue as long as it is desired that the bobbing buoy 20 collect and transmit oceanographic data.

In order to collect the oceanographic data the bobbing buoy may be provided with an ocean sensor 50, such as a thermistor for sensing the temperature of the water. The oceanographic sensor may be connected to a recorder 52 which in turn is connected to a transmitter 54. The transmitter 54 in turn is connected to an antenna 56 which extends from the top of the bobbing buoy 20 for transmitting the oceanographic data to a remote location, such as a surface ship (not shown). The components 50, 52, and 54 may receive their power from the battery 46 by leads which are not shown.

Another embodiment of the benthic bobbing buoy system is illustrated at 60 in FIGS. 3 and 4 of the drawings. The benthic bobbing buoy system 60 may include the anchor 12, the buoy 14, and the anchor line 16 which connects the submerged buoy 14 to the anchor 12. The system 60 may further include the bobbing buoy 20 and the bobbing line 22 which connects the bobbing buoy 20 to the submerged buoy 14. The connection of the bobbing buoy 20 in the system 60 to the submerged buoy 14 is different from the connection illustrated in the embodiment 10 in that rather than being connected directly to the submerged buoy 14 the bobbing buoy 20 of the system 60 is indirectly connected to the submerged buoy 14. The bobbing line 22 is connected to negatively buoyant means 62 which is slideably mounted on the anchor line 16 between the anchor 12 and the submerged buoy 14. The descent limiting means of the embodiment 60 includes the slideable negatively buoyant means 62, and a pair of stops 64 and 66 which are located above and below the negatively buoyant means 62 for limiting the upward and downward movements of the negatively buoyant means 62 on the anchor line 16. The bottom stop 64 limits the downward movement of the negatively buoyant means 62 and the upper stop 66 limits the upward movement of the negatively buoyant means 62 so that the bobbing buoy 20 can be cycled between the submerged position, as illustrated in FIG. 3, to the surfaced position, as illustrated in FIG. 4. As illustrated in FIG. 5 the slideable negatively buoyant means 62 may be a negatively buoyant buoy which has a passageway 68 along its longitudinal axis for slideably receiving the anchor line 16.

The bobbing buoy 20 of the bobbing buoy system 60 may include the same components as illustrated in FIG. 6. The bobbing buoy 20 of this embodiment will cycle between the submerged and surfaced positions in essentially the same manner as described for the bobbing buoy system 10 illustrated in FIGS. 1 and 2. There is one significant difference in the operation of the system 10 over the system 60 and that is that the bobbing buoy 20 of the system 10 will more nearly maintain a predetermined submerged depth when there are current changes than the bobbing buoy 20 of the system 60. Accordingly, when a predetermined depth for obtaining oceanographic data is critical the bobbing buoy system 10 should be utilized. However, the bobbing buoy system 60 has an advantage over the system 10 in that there is less likelihood of entanglement of the lines.

OPERATION OF INVENTION

In the operation of either of the systems 10 or 60 an operator aboard a surface vessel may throw either of these systems overboard and the systems will assume their respective positions in the water. In the submerged position the systems will obtain oceanographic data and after a predetermined time the bobbing buoy will surface to transmit the oceanographic data to a remote location such as a surface ship. The bobbing buoy of both systems 10 and 60 will continue to cycle between the submerged and surfaced positions to obtain and transmit oceanographic data as long as the system is designed to operate.

Obviously, many modifications and variations of the present invention are possible in the light of the above teachings, and, it is therefore understood that within the scope of the disclosed inventive concept, the invention may be practiced otherwise than specifically described.

What is claimed is:

1. A benthic bobbing buoy system comprising:

an anchor;

a buoy;

an anchor line connecting the buoy to the anchor;

said anchor line being of a length to establish the buoy in a submerged position;

another buoy for bobbing between the surface of the water and a submerged position;

a bobbing line connecting the bobbing buoy to the submerged buoy;

a weight connected to the bobbing line intermediate its ends for limiting the descent of the bobbing for cooperating with said bobbing buoy for forming a bobbing buoy-weight system buoy when the bobbing buoy-weight system is negatively buoyant;

means for selectively changing the buoyancy of the bobbing buoy-weight system between a positively buoyant condition to a negatively buoyant condition;

the length of the bobbing line between the submerged buoy and the weight means being represented by $L_1$, and the length of the bobbing line between the weight means and the bobbing buoy being represented by $L_2$; and $L_2$ being greater in length than $L_1$ so that during all positions of the bobbing buoy tension is maintained on all of the lines to prevent entanglement thereof.

2. A benthic bobbing buoy system as claimed in claim 1 wherein the buoyancy changing means includes:

an inflatable bag mounted to the bobbing buoy, the inflatable bag having an inlet and an outlet;

gas generation means mounted to the bobbing buoy and connected to the inlet of the inflatable bag;

means mounted to the bobbing buoy for selectively introducing gas from the gas generation means into the inflatable bag through said inlet and for selectively opening and closing said outlet.

3. A benthic bobbing buoy as claimed in claim 2 including:

an oceanographic data collecting package mounted on the bobbing buoy for collecting oceanographic data when the bobbing buoy is submerged;

a recorder mounted on the bobbing buoy and connected to the oceanographic data collecting package for recording the oceanographic data; and a transmitter system mounted on the bobbing buoy and connected to the recorder for transmitting the recorded data when the bobbing buoy surfaces the water.

4. A benthic bobbing buoy system comprising:

an anchor;

a buoy;

an anchor line connecting the buoy to the anchor;

said anchor line being of a length to establish the buoy in a submerged position;

another buoy for bobbing between the surface of the water and a submerged position;

a bobbing line connecting the bobbing buoy to the submerged buoy;

means for selectively changing the buoyancy of the bobbing buoy between a positively buoyant condition to a less positively buoyant condition;

negatively buoyant means slideably mounted on the anchor line between the anchor and the submerged buoy;

the bobbing line being connected to the slideable negatively buoyant means so as to make said connection to the submerged buoy; and a pair of stops mounted on the anchor line for limiting the upward and downward movement of the slidable negatively buoyant means on the anchor line;

whereby the bottom stop limits the descent of the bobbing buoy and the upper stop limits the extent of the upward movement of the bobbing buoy.

5. A benthic bobbing buoy as claimed in claim 4 wherein the buoyancy changing means includes:

an inflatable bag mounted to the bobbing buoy, the inflatable bag having an inlet and an outlet;

gas generation means mounted to the bobbing buoy and connected to the inlet of the inflatable bag;

means mounted to the bobbing buoy for selectively introducing gas from the gas generation means into the inflatable bag through said inlet and for selectively opening and closing said outlet.

6. A benthic bobbing buoy as claimed in claim 5 including:

an oceanographic data collecting package mounted on the bobbing buoy for collecting oceanographic data when the bobbing buoy is submerged;

a recorder mounted on the bobbing buoy and connected to the oceanographic data collecting package for recording the oceanographic data; and a transmitter system mounted on the bobbing buoy and connected to the recorder for transmitting the recorded data when the bobbing buoy surfaces the water.

* * * * *